United States Patent [19]

Corsette

[11] 4,343,417

[45] Aug. 10, 1982

[54] DISPENSING PUMP LOCKING MEANS

[76] Inventor: Douglas F. Corsette, 6559 Firebrand St., Los Angeles, Calif. 90045

[21] Appl. No.: 121,001

[22] Filed: Feb. 13, 1980

[51] Int. Cl.[3] ..... B67D 5/32

[52] U.S. Cl. ..... 222/153; 222/384

[58] Field of Search ..... 222/153, 384, 402.11

[56] References Cited

U.S. PATENT DOCUMENTS

| | | | |
|---|---|---|---|
| 3,426,948 | 2/1969 | Stirling | 222/402.11 |
| 3,797,705 | 3/1974 | Cooprider | 222/153 |
| 3,827,605 | 8/1974 | Knickerbocker | 222/153 |
| 3,827,606 | 8/1974 | Knickerbocker | 222/384 |
| 4,050,613 | 9/1977 | Corsette | 222/321 |
| 4,083,476 | 4/1978 | Schwartz et al. | 222/498 X |

*Primary Examiner*—Robert J. Spar
*Assistant Examiner*—Frederick R. Handren
*Attorney, Agent, or Firm*—Watson, Cole, Grindle & Watson

[57] ABSTRACT

In a dispensing pump including a reciprocable plunger having a locking finger on a pump body member and the cam on a control member rotatable relative thereto for immobilizing the plunger as an upper portion of the finger is deflected into the path of reciprocation of the plunger, another cam is provided on the control member for positively deflecting such upper portion out of such path of reciprocation so as to avoid complete reliance on the locking finger retracting from such path in a normal unstressed condition thereof.

Alternatively, a stop shoulder on the plunger on which the free end of the locking finger bears to effect plunger mobilization may be beveled and the free end accordingly sloped so as to positively retract the locking finger out of the path of the stop shoulder upon plunger reciprocation.

19 Claims, 7 Drawing Figures

DISPENSING PUMP LOCKING MEANS

BACKGROUND OF THE INVENTION

This invention relates generally to an improvment in a liquid dispensing pump of the hand-held variety which has a plunger immobilizing means for selectively immobilizing the reciprocable pump plunger for preventing inadvertent discharge or leakage of the product during shipment and during periods of non-use of the pump.

More particularly, this invention represents an improvement over U.S. Pat. No. 3,827,606 as well as over Nos. 3,827,605 and 3,797,705.

Dispensing pumps are disclosed by these patents as having locking tongues or fingers which are deflectable by cam surfaces into the path of reciprocation of a stop shoulder provided on the plunger upon relative rotation between members containing the cams and locking fingers. The locking tongues or fingers are retracted out of such path of reciprocation when in an unstressed condition so that the plunger may be freely depressed without interference. These locking fingers or tongues are typically of a relatively stiff plastic material sufficiently flexible as to permit their deflection into the path of reciprocation of the stop shoulder to effect plunger immobilization. The tongues or fingers lie in their normal or unstressed conditions radially outwardly from such path of reciprocation; after being deflected, they return to their unstressed condition under their own elastic memory as the cam surfaces recede from the locking fingers upon such relative rotation. Sole reliance on this elastic memory of the tongues or fingers for retracting them away from the path of reciprocation of the stop shoulder to permit actuation of the pump, may render the dispensing pump inoperable if the elastic memroy is lost or diminishes during the shelf life of the product. The locking fingers cannot be expected to freely retract if, because of the cold flow of the plastic, much of the memory is lost.

SUMMARY OF THE INVENTION

It is therefore the principle object of this invention to provide a dispensing pump of the aforedescribed type having a plunger immobilizing means as well as a means for positively retracting the locking fingers from the path of reciprocation of the stop shoulder on relative rotation between a control ring and the pump body, so that, in the event that the elastic memory of the locking fingers fails or diminishes, any interference with the ability to reciprocate the plunger will be avoided. Thus, the locking fingers' elasticity for retracting them into an unlocked position upon relative rotation of the control and pump body members, is not solely relied on.

The control member comprises an annular ring mounted on the pump body for relative rotary movement and has an axial opening through which the plunger extends during reciprocation. At least one upstanding locking finger is secured to the pump body member and, in accordance with one embodiment, first and second cam elements are carried by the control member for engaging opposite sides of the finger so as to move the free end thereof respectively into and out of the path of the stop shoulder reciprocation upon such relative rotary movement for both positively immobilizing the plunger and permitting it to be freely depressed wihout interference.

In accordance with another embodiment of the invention, the locking finger has a locking pawl thereon for engagement with the stop shoulder upon deflection of the finger into such path of reciprocation, and for disengagement from the locking shoulder when the locking finger is deflected out of such path.

A further embodiment of this invention includes only a locking cam on the control member for deflecting it into the path of reciprocation of the stop shoulder upon relative rotation of the control and pump body members, the stop shoulder being outwardly beveled so as to define an unlocking cam which bears against a sloping end surface of the locking finger for deflecting it out of the path of such reciprocation in the event the elastic memory thereof is lost or diminished. Means are provided for resiliently urging the plunger head upwardly toward a fully raised position, and cooperating means comprising an annular beveled surface adjacent the stop shoulder and in engagement with an annular surface on the control member are provided for arresting upward movement of the plunger head at the fully raised position.

Other objects, advantages and novel features of the invention will become more apparent from the following detailed description of the invention when taken in conjunction with the accompanying drawings.

DETAILED DESCRIPTION OF THE INVENTION

Figure 1:
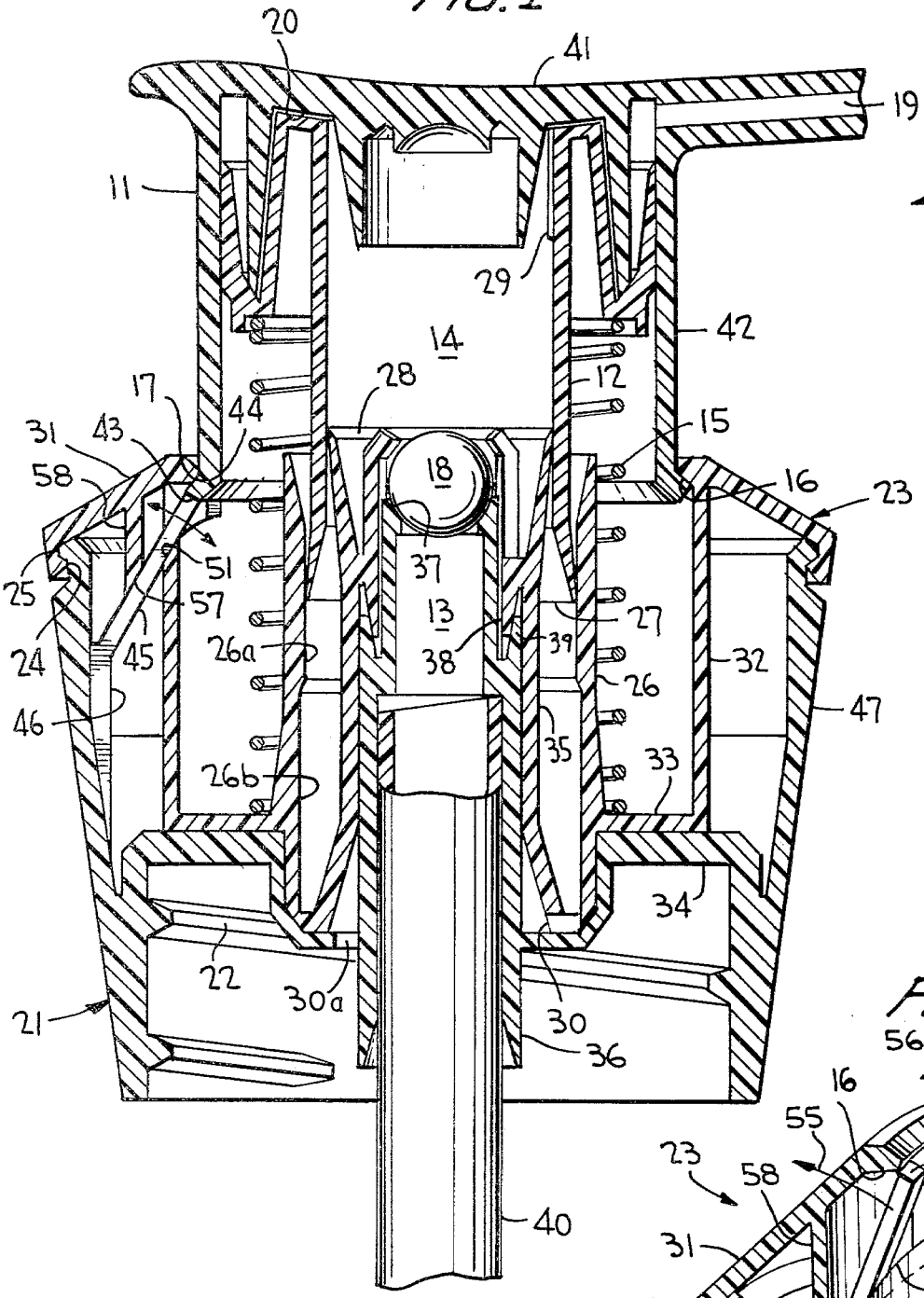
FIG. 1 is a vertical sectional view taken through a dispensing pump embodying the present invention.
Figure 5:
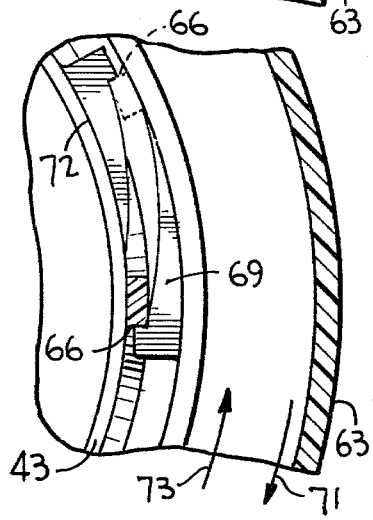
FIG. 5 is a sectional view taken through line 5—5 of a portion of a dispensing pump of FIG. 3.

Turning now to the drawings wherein like reference characters refer to like and corresponding parts throughout the several views, a dispensing pump 10 is shown in FIG. 1 similar to that shown in FIG. 5 of my co-pending application Ser. No. 121,223 except that pump 10 hereof includes a plunger locking and unlocking means. The present pump is an improvement over that disclosed in my prior U.S. Pat. No. 4,050,613, and includes a plunger head 11 formed to provide a downwardly directed blind socket 20 which snugly slideably receives a tubular plunger 12 and therewith defines an enclosed variable volume accumulation chamber communicating through the plunger with the valve controlled upper end of an inlet passage 13. This accumulation chamber has an appreciably larger diameter than variable volume pump chamber 14 (defined by the plunger and the piston), and the annular upwardly presented end of the plunger is exposed to downward fluid pressure within the accumulation chamber in opposition to the upward thrust of a return spring 15. Therefore, at the commencement of the priming and/or pumping operation, spring 15 maintains the plunger in its fully raised position (FIG. 1) in sealing relation with the blind upper end of the socket defined by the plunger head, the head being held against upward displacement by the interengagement of annular stops defined by surfaces 16 and 17.

On the downward stroke of plunger head, liquid in the pump chamber is compressed as an inlet ball valve 18 is fully seated so that, as the compression stroke continues, there will be a progressive increase in fluid pressure within the accumulation chamber until such pressure creates a downward force on the plunger sufficient to overcome the resilient upward thrust of the spring. This will result in downward movement of the plunger to thereby uncover the end of a discharge passage 19. Whenever the pressure within the accumulation chamber becomes insufficient to maintain the discharge passage open, the spring pressure will again reseat the plunger within the plunger head socket so as to close the discharge passage. During the return stroke, the volume of the pump chamber increases to thereby open the inlet valve. The aforedescribed arrangement and operation of pump 10 is essentially the same as set forth in my aforementioned pending application and in U.S. Pat. No. 4,050,613.

The dispensing pump further includes a pump body member 21 secured in fluid tight manner on a container (not shown) of flowable product to be dispensed, member 21 having internal threads 22 for this purpose. An annular control member 23 is secured to the pump body member for relative rotary movement by means of cooperating annular lugs 24 and 25, respectively provided on the members. The control member includes an integral cylindrical wall 26 having first and second inner diameters **26*a* and 26*b* which function together with skirt 27, lip 28 and rib 29 for purging accumulated air, from the pump chamber during priming, directly into the container via openings 30 and 30*a***, all as described in detail in my aforementioned copending application.

The closure member further includes an annular ring 31 and an outer cylindrical wall 32 depending therefrom, and a transversely extending annular wall 33 interconnecting cylindrical walls 26 and 32 and overlying a top wall 34 of the cap portion of the pump body member. The control member also includes an upstanding tubular piston 35 having lip 28 at its upper end and surrounding an upstanding post 36 which is integrally connected with wall 34 and which has a ball seat 37 at its upper end. Tapered annular flanges 38 and 39 are respectively provided on piston 35 and on post 36 and are in sealing engagement with one another so as to define a rotary seal which prevents any loss of pressure from pump chamber 14. Post 36 tightly receives the upper end of a dip tube 40 which extends at its lower end into the container as in a well known manner.

Plunger head 11 is conformed to present an upwardly directed finger piece 41 by which intermittent finger pressure may be conveniently applied to it to be transmitted to plunger 12 for producing reciprocation thereof on piston 35. Also, the plunger head includes a depending annular skirt 42 having radially extending rib 17 at its lower end. Lower edge 43 of skirt 42 defines an annular stop shoulder encircling the plunger and is located at a predetermined level such that in the fully raised or projected position of the plunger, as shown in FIG. 1, the stop shoulder is adapted for co-action with the locking means of the invention more fully hereinafter described. The stop shoulder extends through an axial opening 44 of ring 31.

Locking fingers 45 (only one of which being shown in FIGS. 1 and 2) are affixed as by molding at base 46 thereof to the inner surface of an upstanding annular wall 47 of the pump body member. These locking fingers, three or more, are equally spaced apart and have a free end 48 in abutting engagement with stop shoulder 43 when in the plunger head locking position of FIG. 1. The locking fingers thus present stability against eccentric loads and the deleterious effects of these loads when the locking resistance is at or near the center of the plunger head.

Figure 2:
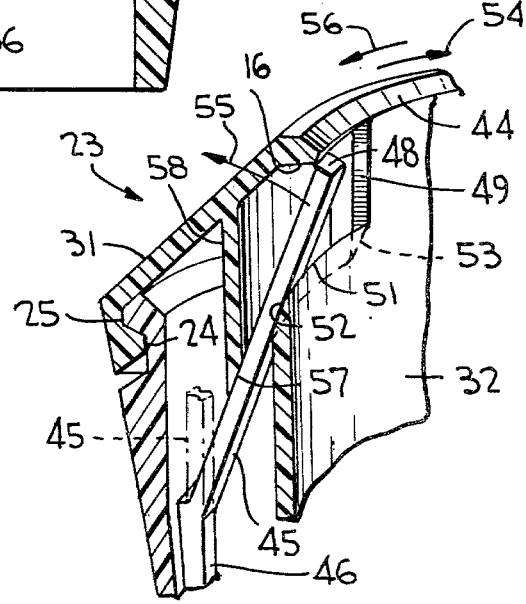
FIG. 2 is an enlarged detail view of the pump locking and unlocking means of FIG. 1.

As more clearly seen in FIG. 2, wall 32 of the closure member has an opening 49 located at the upper end thereof. Lower edge 51 of this opening extends in a spiral fashion and is circumferentially tapered so as to recede (from end 53 to end 52 of the lowest edge) from locking finger 45 when the control member is rotated clockwise in the direction of arrow 54 of FIG. 2. And, lower edge 51 serves to positively deflect the locking finger in the direction of arrow 55 when the control member is rotated counterclockwise (in the direction of arrow 56) from one end 52 of the lower edge to the opposite end 53 thereof. Lower edge 51 thus comprises an unlocking cam since its principle function is to assure that the locking finger pivots about its base from the position shown in FIG. 2 and in the direction of arrow 55 during a counterclockwise rotary movement of the control member.

A locking cam is defined by a lower edge 57 of a flange 58 depending from ring 31 and lying radially outwardly of slot 49. This lower edge 58 likewise entends in a spiral fashion from a lower left end (when viewed in FIG. 2) to a higher right end thereof and is circumferentially tapered so as to essentially match the contour of edge 51. Thus, edge 57 recedes from the locking finger on unlocking when the control member is moved counterclockwise (in the direction of arrow 56) so as to permit the unlocking cam or edge 51 to assure movement of the locking finger into an unlocked position. On the other hand, edge 57 bears against the locking finger to shift it into its locking position. FIG. 2, (upon clockwise rotary movement of the closure member in the direction of arrow 54) and any interference by edge 51 is avoided since, as described above, it recedes from the locking finger on unlocking. It should be pointed out that FIG. 2 typically shows details of a locking finger with its cooperating and unlocking cams, although three or more of such locking means may be spaced equally apart around the plunger head. Also, for ease in molding, the locking fingers are molded in place generally upright (shown in phantom outline in FIG. 2) so as to lie parallel to the pump axis. On assembly, the locking fingers are inserted into their respective slots 49 to thereby inwardly pivot the locking fingers. It should be furthermore pointed out that the off-center relationship between the unlocking and locking cams relative to the locking finger supports the locking finger against buckling loads as might be applied to the plunger head.

Figure 3:
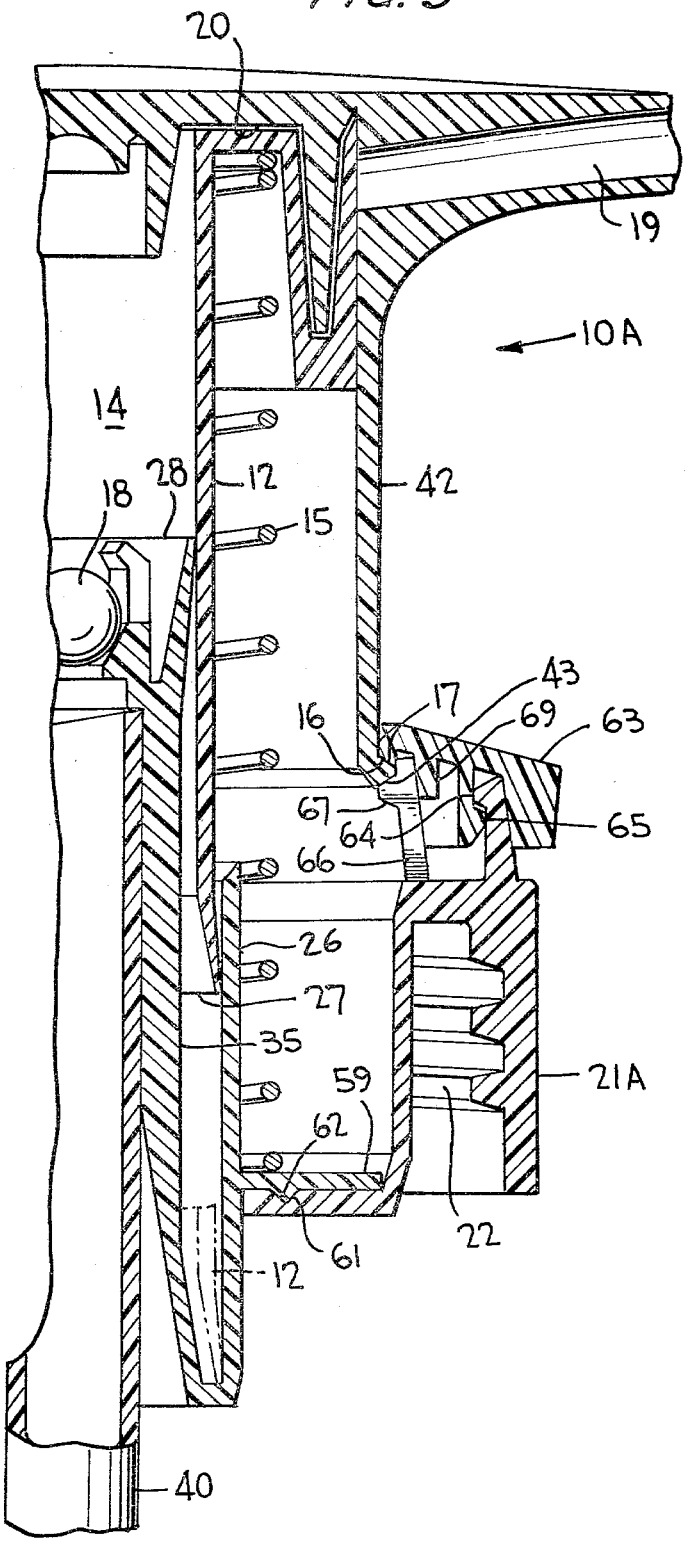
FIG. 3 is a vertical half-section taken through a dispensing pump incorporating another embodiment of the invention and showing a cam locking feature.

Dispensing pump 10A of FIG. 3 is similar in many respects to pump 10 so that like parts will be identified by like reference numerals. The pump operates the same as pump 10 and as described in my aforementioned U.S. Pat. No. 4,050,613. Pump body member 21A of pump 10A includes a closure cap for securing the pump in a fluid type manner on a container (not shown) of flowable product to be dispensed. As in the earlier described embodiment, cylindrical wall 26 is integral with upstanding tubular piston 35, except that this piston itself receives the upper end of dip tube 40, and a horizontal flange 59 extends outwardly of wall 26. An annular groove 61 is provided in the upper face of wall 34 for the reception of an annular tongue 62 depending from wall 59. Coaction between the tongue and groove effects a good seal between mating flanges 59 and 34.

A control member in the form of an annular ring 63 is mounted on the pump body member for relative rotary movement by means of cooperating annular lugs 64 and 65. Cooperating lugs 16 and 17 respectively on plunger skirt 42 and ring 63 define a means for arresting upward movement of the plunger head at the fully raised position of FIG. 3. And, as in the aforedescribed embodiment, stop shoulder 43 defined by a lower edge of the skirt is beveled inwardly toward the axis of reciprocation of the plunger. A plurality of locking fingers 66 (only one of which being shown in FIGS. 3 and 4) are equally spaced apart around the plunger head and, as similarly shown in the aforementioned U.S. Pat. No. 3,827,606, are displaced radially outwardly from the path of reciprocation of the downwardly presented locking shoulder 43 of the plunger, so that the plunger may be freely depressed to its position shown in phantom outline in FIG. 3 when in the unlocked position of FIG. 4. Each locking finger has an inwardly extending locking pawl 67 thereon having an upper surface 68 engageable with stop shoulder 43 when shifted into the locking position of FIG. 3.

Figure 4:
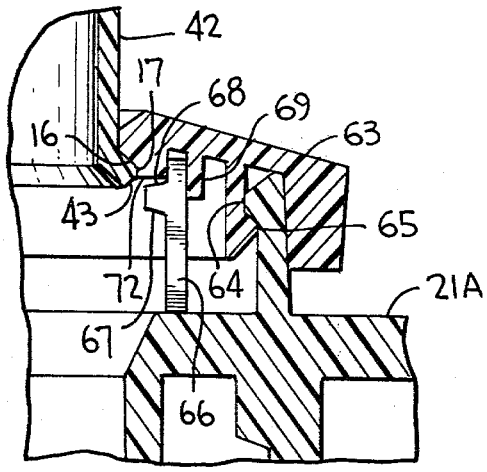
FIG. 4 is a view similar to FIG. 3 showing the cam unlocking feature thereof.

Control ring 63 has a locking cam 69 depending therefrom in the form of a cam element in engagement with an outer side of the locking finger and gradually increasing in size as in the manner shown in FIG. 5 so that, upon a counterclockwise rotary movement of the control ring in the direction of arrow 73 of FIG. 5, the locking finger will be shifted from its unlocking position of FIG. 4 to its locked position of FIG. 3 wherein the locking pawl is inwardly deflected until its upper surface 68 is brought to bear against stop shoulder 43. The locking finger is shown in phantom outline in FIG. 5 in it unlocking position and in solid outline in this Figure in its locking position.

The control ring likewise has a depending unlocking cam 72 in contact engagement with the opposite side of the locking finger, the cam being so formed that the thickest portion occupies the space between the locking finger in its relaxed position of FIG. 4 and the outer edge of lug 17. The unlocking cam tapers from this thickened section gradually to its thinnest section shown in FIGS. 3 and 5 so as to assure that the locking finger will deflect outwardly from its position shown in solid outline in FIG. 5 to that shown in phantom outline therein upon rotary movement of the control ring in a clockwise direction shown by arrow 71.

The locking finger and the associated locking and unlocking cams as aforedescribed, are typical of several such arrangements (for example, three or more) equally spaced around the plunger for stability purposes as described with reference to FIG. 1. The fingers, of any suitable plastic material, are relatively stiff but nevertheless have sufficient resilient flexibility so as to permit their inward deflection into the FIG. 3 locking position. Because of their flexibility, they will possess a certain degree of elastic memory causing them to retract outwardly to their unlocking position. However, the elastic memory of the plastic has been found not very reliable for a dispenser which may have a shelf life of up to two years because cold flow of the plastic may cause much of the memory to be lost. The unlocking cam 72 therefore assures that the locking finger will retract to its unlocking position so as to permit the plunger to be depressed without interference during use.

Figure 6:
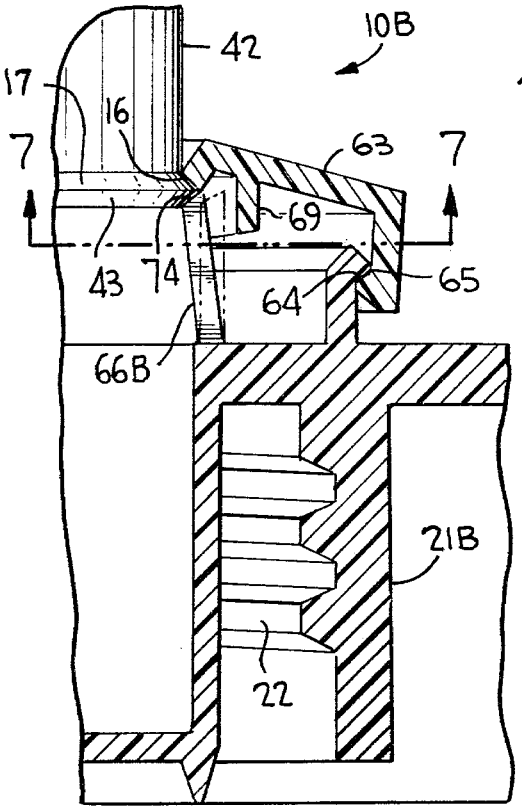
FIG. 6 is a vertical sectional view of a portion of a dispensing pump incorporation a further embodiment of the invention.
Figure 7:
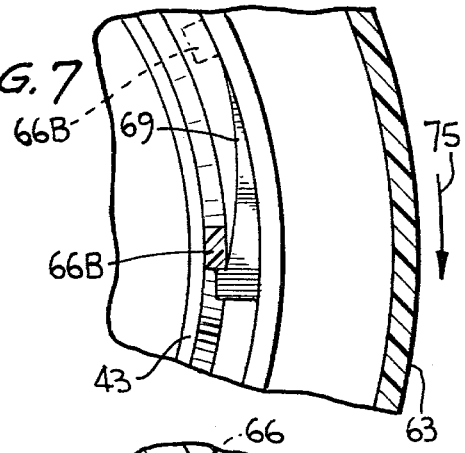
FIG. 7 is a sectional view taken along line 7—7 of FIG. 6.

Dispensing pump 10B of FIG. 6 is the same as pump 10A except that control ring 63 is provided with only a locking cam 69 thickened at one predetermined end and tapering gradually away from locking finger 66B as shown in FIG. 7. The locking cam is thus the same as that described with reference to FIGS. 4 and 5, and bears against an outer surface of the locking finger so as to inwardly deflect it from its position shown in phantom outline in FIGS. 6 and 7 inwardly toward the axis of reciprocation of the plunger to its solid outline position as shown in these Figures. It is noted that in this embodiment, the locking finger does not have a locking pawl but is designed so that its upper free end 74 is deflected into abutting engagement with stop shoulder 43. This end 74 slopes downwardly and inwardly toward the axis of reciprocation, and stop shoulder 43 is beveled so as to extend upwardly and outwardly from such axis. Thus, if the locking finger fails to retract when the control ring is rotated clockwise in the direction of arrow 75 of FIG. 7 whereby the bearing edge of the locking cam gradually recedes from the stop shoulder, because of the diminished or lost elastic memory of the locking finger, the angled mating surfaces 43 and 74 will cause the upper end of the locking finger to retract radially outwardly upon the plunger head downstroke. Any interference with operation of the pump is therefore substantially avoided, and the beveled stop shoulder thus functions as an unlocking cam.

From the foregoing it can be seen that a dispensing pump has been devised as having both a plunger immobilization feature which locks the plunger in its fully raised position, as well as a means for positively unlocking the plunger to permit plunger reciprocation without interference when in use. The elastic memory of locking fingers or tongues is not solely relied on to assure retraction of the locking fingers away from beneath the plunger head to permit plunger reciprocation without interference. The unlocking cam means according to the invention is reliable, simple to operate and easy to operate as well as to assemble.

Obviously, many other modifications and variations of the present invention are made possible in light of the above teachings. For example, the locking and unlocking cams described herein, may be reversed so that locking takes place upon a counterclockwise rotation of the control ring, and vice versa. Also, the cam locking and unlocking features of the invention can be applied to dispensing pumps other than the types disclosed herein for immobilizing the movable plunger during non-use and storage and for permitting it to freely reciprocate during use. It is therefore to be understood, that within the scope of the appended claims the invention may be practiced otherwise than as specifically described.

What is claimed is:

1. In a dispensing pump having a finger-operated plunger head mounted for reciprocation on a pump body member secured in a fluid tight manner on a container of flowable product to be dispensed, reciprocation of said head effecting the dispensing of the product, a downwardly facing stop shoulder on said head, a control member rotatably mounted on said body member and having an axial opening through which said stop shoulder extends during plunger reciprocation, at least one upstanding locking finger secured to one of said members and being deflectable transversely to the axis of reciprocation of said plunger into the path of reciprocation of said stop shoulder, the improvement wherein first and second cam means are provided on the other of said members for engaging said finger to positively deflect said finger transversely into as well as out of the path of said stop shoulder, respectively, in response to relative rotary movement of said members, said first and second cam means lying opposite each other and being in constant engagement with opposite sides of said finger during said relative rotary movement for supporting said finger against any buckling loads applied to said plunger when selectively immobilized upon deflection of said finger into said path of reciprocation, and for avoiding any interference between said head and said finger during during reciprocation of said head when said finger is deflected out of said path of reciprocation.

2. In the pump according to claim 1, wherein said cam means are provided on said control member, means resiliently urging said plunger head upwardly toward a fully raised position, and cooperating means on said head and said control member for arresting upward movement of said plunger head at said fully raised position.

3. In the pump according to claim 2, wherein said finger has a locking pawl thereon for engagement with said stop shoulder upon deflection of said finger into said path of reciprocation.

4. In the pump according to claim 2, wherein a free end of said finger engages said stop shoulder upon deflection of said finger into said path of reciprocation.

5. In the pump according to claim 3, wherein a plurality of said locking fingers are secured to said body member and are arranged in an annular formation around said plunger, said fingers having locking pawls thereon at a common level for engagement with said stop shoulder upon deflection of said fingers into said path of reciprocation, and a like plurality of said first and second cam means respectively associated with said fingers for simultaneously transversely deflecting said fingers to effect engagement between said pawls and said stop shoulder upon relative rotation of said members.

6. In the pump according to claim 4, wherein a plurality of said locking fingers are secured to said body member and are arranged in an annular formation around said plunger with their free upper ends at a common level, normally spaced radially from said head and out of said path, and a like plurality of said first and second cam means respectively associated with said fingers for simultaneously transversely deflecting said free ends into and out of said path upon relative rotation of said members.

7. In the pump according to claim 1, wherein said first and second cam means are offset relative to each other on opposite sides of said finger.

8. In the pump according to claim 7, wherein said other member includes a pair of spaced walls having edges along which said first and second cam means lie.

9. In the pump according to claim 8, wherein one of said edges is defined by an opening provided in one of said walls, said finger extending through said opening upon deflection into said path of reciprocation.

10. In the pump according to claim 1, wherein said finger has a locking panel thereon for engagement with said shoulder upon deflection of said finger into said path of reciprocation, said first and second cam means defining a cam path along which said finger is guided during said relative rotary movement.

11. In a dispensing pump having a finger-operated plunger head mounted for reciprocation on a pump body member secured in fluid tight manner on a container of flowable product to be dispensed, reciprocation of said head effecting the dispensing of the product, a downwardly facing stop shoulder on said head, a control member rotatably mounted on said body member and having an axial opening through which said stop shoulder extends during plunger reciprocation, at least one upstanding locking finger secured to one of said members with a free end thereof projecting parallel to the axis of reciprocation of said plunger and being deflectable transversely to said axis into the path of reciprocation of said stop shoulder, and cam means on the other of said members for transversely deflecting said free end responsive to relative rotation of said members, the improvement wherein said stop shoulder comprises a first annular surface beveled downwardly and inwardly toward said axis, and said free end of said finger sloping upwardly and outwardly for engagement with said annular surface when deflected into said path by said cam means, said finger being spaced radially outwardly of said stop shoulder and said free end normally lying out of said path in an unstressed condition of said locking finger, although said beveled annular surface when necessary will force said free end out of said path during plunger reciprocation upon contacting said sloping free end.

12. In the pump according to claim 11, wherein said cam means is provided on said control member, means resiliently urging said plunger head upwardly toward a fully raised position, and cooperating means on said head and said control member for arresting upward movement of said plunger head at said fully raised position, said cooperating means comprising a second annular surface adjacent said first surface and beveling upwardly and inwardly toward said axis, and an annular surface on said control member sloping downwardly and outwardly for engagement with said second surface.

13. In a dispensing pump having a reciprocable plunger head mounted on a pump body member secured in fluid tight manner on a container of flowable product to be dispensed, a downwardly facing stop shoulder on said head, a control member mounted for relative rotary movement on said body member and having an axial opening through which said stop shoulder extends during plunger reciprocation, at least one upstanding locking finger secured to said body member and being deflectable transversely to the axis of reciprocation of said plunger into the path of reciprocation of said stop shoulder, said control member having first cam means thereon and engaging said finger to deflect the same transversely into said path, and said finger being retracted from said path in a normal unstressed condition of said locking finger, responsive to relative rotary movement of said members, the improvement wherein second cam means are provided on one of said plunger and said control member for engaging said locking finger for positively retracting said finger from said path in the event said finger fails to retract from said path in its normal unstressed condition upon said relative rotary movement, said first and second cam means lying opposite each other and being in constant engagement with opposite sides of said finger during said relative rotary movement, whereby said cam means support said finger against any buckling loads applied to said plunger head upon the deflection of said finger into said path.

14. In the pump according to claim 13, wherein said first and second cam means comprise cam elements on said control member for positively deflecting said finger transversely into as well as out of said path upon relative rotation of said members.

15. In the pump according to claim 14, wherein said finger has a locking pawl thereon for engagement with said stop shoulder upon deflection of said finger into said path.

16. In the pump according to claims 13 or 14, wherein a free end of said finger engages said stop shoulder upon deflection of said finger into said path.

17. In a dispensing pump having a reciprocable plunger head mounted on a pump body member secured in fluid tight manner on a container of flowable product to be dispensed, a downwardly facing stop shoulder on said head, a control member mounted for relative rotary movement on said body member and having an axial opening through which said stop shoulder extends during plunger reciprocation, at least one upstanding locking finger secured to said body member and being deflectable transversely to the axis of reciprocation of said plunger into the path of reciprocation of said stop shoulder, said control member having first cam means thereon and engaging said finger to deflect the same transversely into said path, and said finger being retracted from said path in a normal unstressed condition of said locking finger, responsive to relative rotary movement of said members, the improvement wherein said stop shoulder comprises a first annular surface beveled downwardly and inwardly toward said axis so as to define second cam means for engaging said locking finger for retracting said finger from said path in the event said finger fails to retract from said path in its normal unstressed condition upon said relative rotary movement, said finger having a free end sloping upwardly and outwardly for engagement with said annular surface when deflected into said path by said first cam means, said first surface thereby retracting said finger from said path upon plunger reciprocation when said finger fails to otherwise retract to said unstressed condition.

18. In the pump according to claims 13, 14 or 17, wherein means are provided for resiliently urging said plunger head upwardly toward a fully raised position, and cooperating means on said head and said control member for arresting upward movement of said head at said fully raised position.

19. In the pump according to claim 18, wherein said cooperating means comprises a second annular surface beveled downwardly and outwardly of said axis and lies adjacent said stop shoulder, and a surface of said control member matching said second surface.

* * * * *